US007063397B2

(12) United States Patent
Sabounjian

(10) Patent No.: US 7,063,397 B2
(45) Date of Patent: Jun. 20, 2006

(54) SHOE HOLDER

(75) Inventor: Azad Sabounjian, Newport Beach, CA (US)

(73) Assignee: Pro-Mart Industries, Inc., Irvine, CA (US)

( * ) Notice: Subject to any disclaimer, the term of this patent is extended or adjusted under 35 U.S.C. 154(b) by 337 days.

(21) Appl. No.: 10/679,731

(22) Filed: Oct. 6, 2003

(65) Prior Publication Data

US 2005/0074187 A1 Apr. 7, 2005

(51) Int. Cl.
*E04H 1/12* (2006.01)

(52) U.S. Cl. ..... 312/6; 383/38; 206/287.1

(58) Field of Classification Search ..... 312/3, 312/4, 5, 6; 206/378, 286, 287.1; 211/113, 211/118, 34, 38; 220/475, 4.28, 9.1–9.3, 220/507; 383/38, 22, 23, 24, 26, 103, 100, 383/117, 66, 13, 119; 108/42, 180, 193; 190/13 R, 13 F See application file for complete search history.

(56) References Cited

U.S. PATENT DOCUMENTS 1,115,706 A * 11/1914 Manuel ..... 217/44
1,206,618 A 11/1916 Thrasher et al.
1,216,250 A * 2/1917 Bittle ..... 312/6
1,375,883 A * 4/1921 Woolson ..... 312/6
1,583,083 A 5/1926 Macaraig
1,640,083 A * 8/1927 Ladd ..... 211/186
1,678,415 A * 7/1928 Ahles ..... 312/6
1,691,904 A 11/1928 Gamble
1,730,898 A * 10/1929 Percival ..... 383/38
1,847,066 A * 3/1932 Berg ..... 312/6
1,902,313 A * 3/1933 Struble ..... 206/8
2,016,520 A 10/1935 Short
2,142,851 A 1/1939 Jolly
2,517,757 A * 8/1950 Adlerstein ..... 312/3
2,533,333 A * 12/1950 Kitson ..... 190/111
2,584,722 A * 2/1952 London ..... 206/287
2,845,185 A * 7/1958 Winderweedle, Jr. ..... 108/164
2,874,813 A * 2/1959 Bunte ..... 190/109
3,039,599 A * 6/1962 Mintz ..... 206/287
3,105,617 A 10/1963 Felldin
3,669,276 A * 6/1972 Woods ..... 211/34
3,904,258 A * 9/1975 Faulkenberry ..... 312/6
3,929,145 A 12/1975 Schroeder
4,377,314 A * 3/1983 Gevers ..... 312/297
4,382,640 A * 5/1983 Kashden ..... 312/5
5,176,315 A 1/1993 Homel
5,358,440 A 10/1994 Zheng
5,439,017 A 8/1995 Brown (Continued)

*Primary Examiner*—Janet M. Wilkens
(74) *Attorney, Agent, or Firm*—Stetina Brunda Garred & Brucker

(57) ABSTRACT

Disclosed is a collapsible bag comprised of a top panel, a bottom panel, at least one intermediate panel, at least one side wall, and at least one divider panel. Each of the panels and the side wall may be covered with flexible material such that the collapsible bag is movable between an expanded position and a collapsed position. The top panel is spaced apart from the bottom panel with the intermediate panels being interposed therebetween in spaced relation. The side wall partially extends around the top, bottom and intermediate panels to partially enclose the collapsible bag and define a plurality of bays. Each one of the top, intermediate and bottom panels has a tension loop extending therearound and configured to outwardly urge the top, bottom and intermediate panel perimeters such that the top, intermediate and bottom panels are generally held taut.

20 Claims, 4 Drawing Sheets

U.S. PATENT DOCUMENTS 5,560,385 A 10/1996 Zheng
5,664,596 A 9/1997 Zheng
5,713,646 A * 2/1998 Wang ..... 312/3
5,800,067 A 9/1998 Easter
5,941,265 A 8/1999 Zheng
6,092,544 A 7/2000 Zheng
6,098,349 A 8/2000 Zheng
6,155,281 A 12/2000 Zheng
6,315,143 B1 11/2001 Dotts
6,360,761 B1 3/2002 Zheng
6,390,573 B1 * 5/2002 Wang ..... 312/6
D461,638 S 8/2002 Kellogg et al.
6,494,224 B1 12/2002 Zheng
6,668,847 B1 12/2003 Zheng
6,719,157 B1 * 4/2004 Stoddart et al. ..... 211/118
2005/0140253 A1 * 6/2005 Fu ..... 312/6

* cited by examiner

SHOE HOLDER

FIELD OF INVENTION

The present invention relates to collapsible containers and, more particularly, to a uniquely configured collapsible bag for holding shoes and other objects.

STATEMENT RE: FEDERALLY SPONSORED RESEARCH/DEVELOPMENT (Not Applicable)

BACKGROUND

In the prior art, there exists collapsible containers that are configured to hold various objects such as hats and the like. When not used for storing such objects, the collapsible containers may be collapsed in order to reduce the overall dimensions such that storability and transportability is improved. One such collapsible container is shown and described in U.S. Pat. No. 1,691,904 wherein a collapsible bag for hats and similar fragile objects is provided.

Although the collapsible bag in the '904 reference may be collapsed, the need to secure the fabric across the floors of each one of the compartments by employing the drawstring necessarily adds to the complexity of the bag and increases its assembly time. Another disadvantage of the bag described in the '904 reference is that each of the hoops must be assembled and disassembled by attaching and detaching a coupling means disposed on opposing ends of each one of the hoops. Such decoupling increases the complexity of the collapsible bag and increases the overall assembly and disassembly time. Thus, there exists a need in the art for an improved collapsible container having a minimal number of parts and a relatively short assembly and disassembly time.

SUMMARY

There is thus advantageously provided a collapsible bag which specifically addresses and alleviates the above-referenced deficiencies associated with the use of prior art collapsible containers. More particularly, there is advantageously provided a collapsible bag that defines four vertical sides, an upper end and a lower end. The collapsible bag is comprised of a bottom panel, a top panel, at least one intermediate panel, at least one side wall, and at least one divider panel. At the lower end is the bottom panel which defines a bottom panel perimeter and has a tension loop extending around the bottom panel perimeter. At the upper end is the top panel which is spaced apart from the bottom panel and which defines a top panel perimeter and has a tension loop extending therearound. The intermediate panel is interposed between and is axially aligned with the top and bottom panels. The side wall defines the four vertical sides when the collapsible bag is in the expanded position.

The intermediate panel defines an intermediate panel perimeter and has a tension loop extending therearound. The side wall partially extends around and is joined to the top, bottom and intermediate panel perimeters to partially enclose the collapsible bag such that the top, bottom, intermediate and side panels collectively define a plurality of bays. The side wall may be comprised of a single contiguous or uninterrupted piece of fabric material. Alternatively, the fabric material may be comprised of a plurality of sections of fabric material that are secured together. The fabric material may comprise mesh material. Each one of the side walls may extend between adjacent ones of the top, intermediate and bottom panels.

The side wall may also define at least one opening on one of the four vertical sides allowing access into an interior of the collapsible bag. Each one of the top, intermediate, bottom and divider panels and side wall may be fabricated from flexible material such as fabric material. The top, intermediate, bottom and divider panels and side wall may be fabricated from any combination of flexible material such that the bag may be repeatedly moved from the collapsible position to the expanded position, and vice versa. The tension loops of the collapsible bag are configured to outwardly urge each one of the top, bottom and intermediate panel perimeters such that the material covering the top, intermediate and bottom panels is generally held taut. Due to the tautness of the material, the load-carrying capability of each one of the intermediate panels and the bottom panel is enhanced.

The collapsible bag may be configured such that any number of bays may be defined by altering the quantity of divider panels and intermediate panels. The divider panels may be sewn to adjacent ones of the top, intermediate and bottom panels. The top, intermediate and bottom panels may be generally orthogonally shaped with each one of the panels having generally straight sides and rounded corners with each one of the top, intermediate and bottom panels being substantially identically shaped and sized. A perimeter pocket may be formed at the top, intermediate and bottom panels. The tension loop may be enclosed within the perimeter pocket in each one of the panels. The tension loops may be fabricated from flexible strap material such as fiberglass, plastic or a steel alloy such as spring steel such that the tension loop may outwardly urge the respective ones of the top, intermediate and bottom panels. Each one of the tension loops may be formed as an endless or continuous loop. The tension loops used herein are of approximately the same dimension in cross-section, such as circles, squares, or rectangles having a height to width ratio of about 5:1 or less, and preferably about 2:1, and preferably with the height being less than 0.25 inches.

A hanger member may be included in the collapsible bag and may be secured to an exterior surface of the top panel. The hanger member may be configured to engage a horizontally-disposed pole such as a clothes hanger pole of the type typically used in a clothing closet. The hanger member may be oriented in a manner wherein the side of the collapsible bag having the opening is oriented parallel to the pole such that objects may be inserted into and removed from the bays through the opening when the collapsible bag is suspended in a closet with the opening facing the opening of the closet. The hanger member may comprise a sleeve member fabricated from nylon fabric material and may be configured to be releasably mounted on the horizontally disposed pole.

BRIEF DESCRIPTION OF THE DRAWINGS

These as well as other features of the present invention will become more apparent upon reference to the drawings in which like numbers refer to like parts throughout, and in which.

DETAILED DESCRIPTION

Figure 1A:
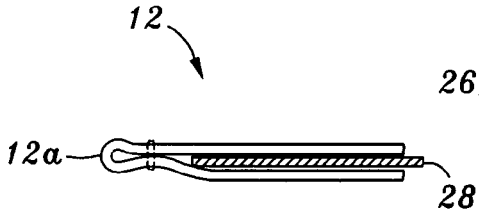
FIG. 1*a* is a partial cross-sectional view of a top panel perimeter of the top panel illustrating a stiffener panel abuttingly disposed against the top panel.
Figure 1B:
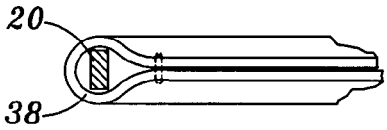
FIG. 1*b* is a partial cross-sectional view of an intermediate panel perimeter illustrating a perimeter pocket and a tension loop enclosed therewithin.
Figure 1C:
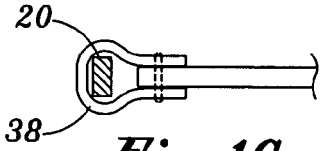
FIG. 1*c* is a partial cross-sectional view of an intermediate panel perimeter illustrating a perimeter edging with the tension loop enclosed therewithin.
Figure 1:
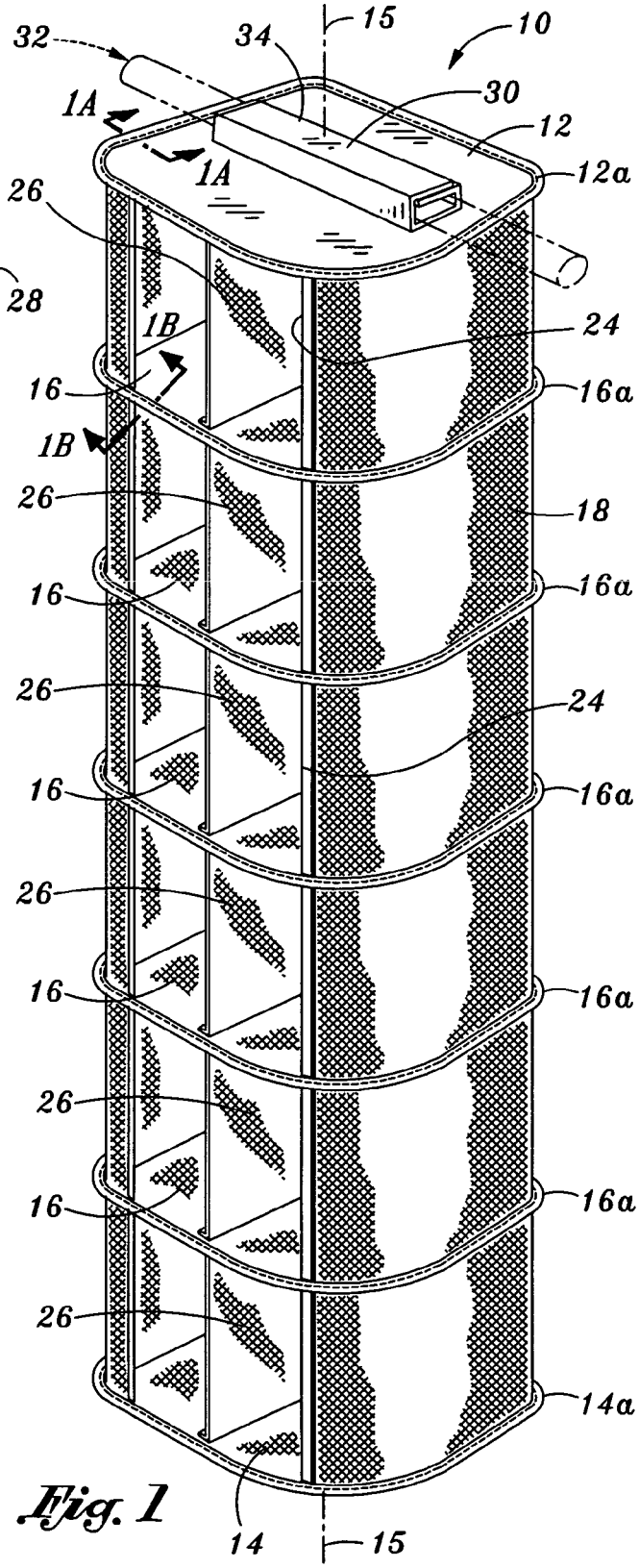
FIG. 1 is a perspective view of a collapsible bag in an extended or expanded position illustrating top, intermediate, bottom and divider panels and a side wall.
Figure 2:
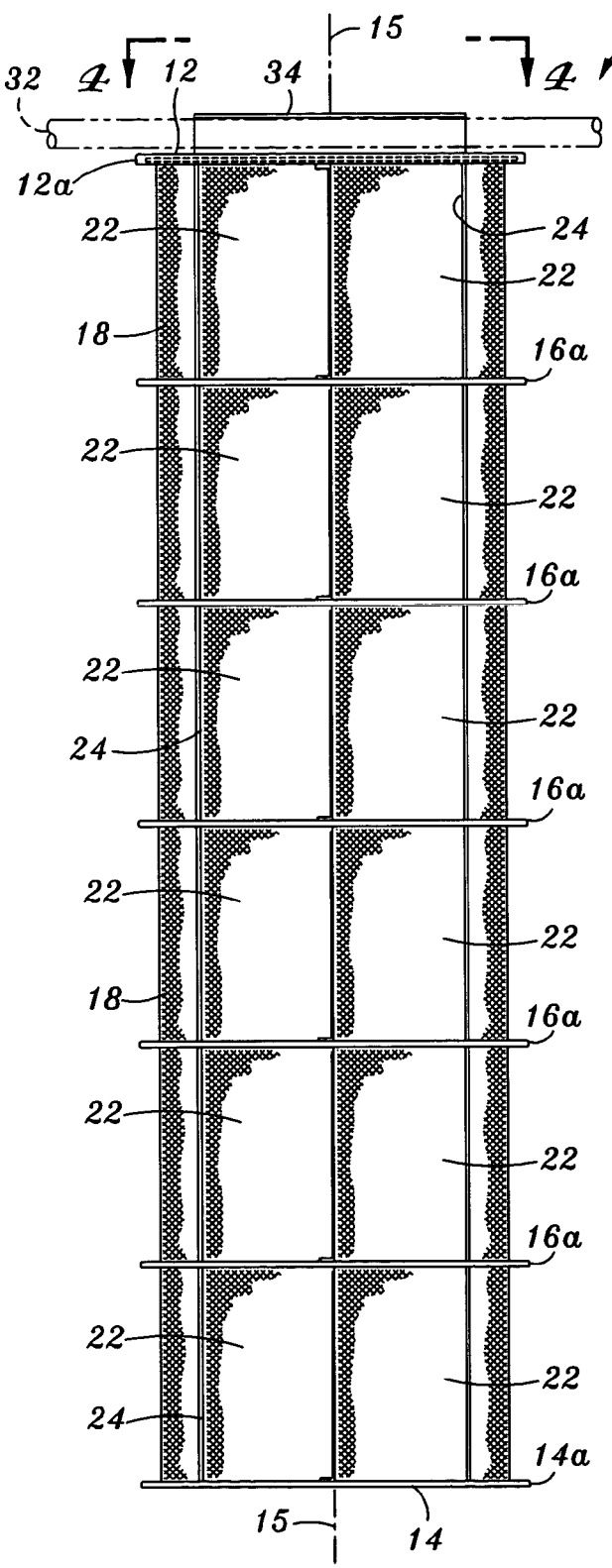
FIG. 2 is a side view of the collapsible bag illustrating a plurality of bays that are collectively defined by the top, intermediate, bottom and divider panels and the side wall.
Figure 3:
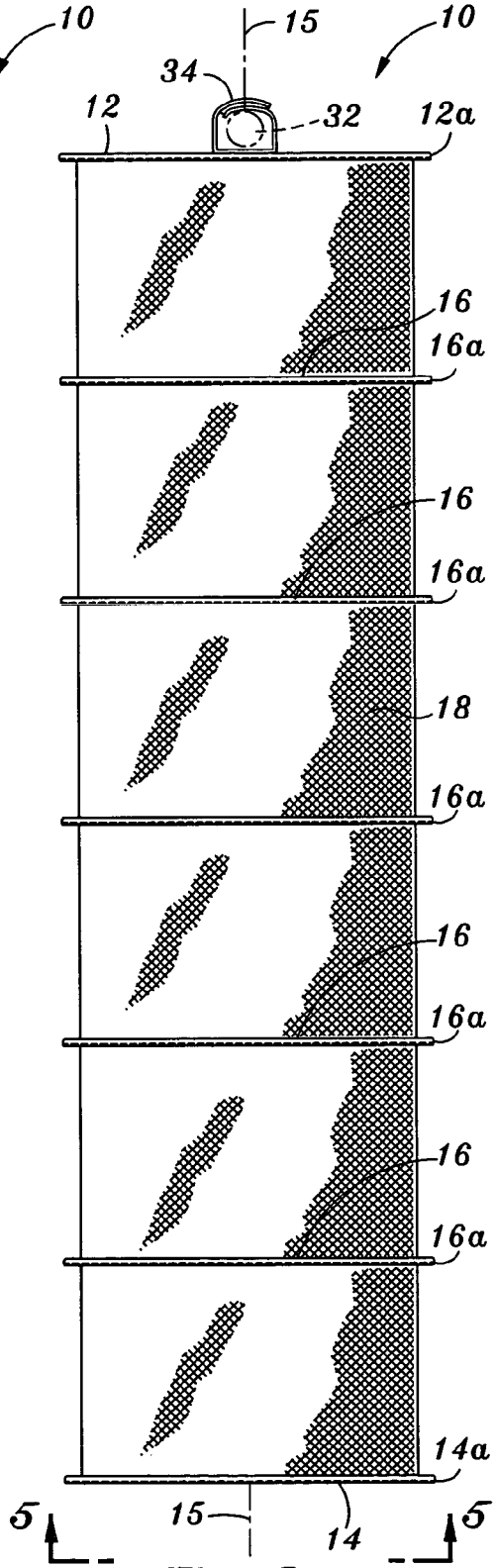
FIG. 3 is a further side view of the collapsible bag shown in FIG. 2 illustrating the arrangement of the intermediate panels in relation to the top and bottom panels.
Figure 6:
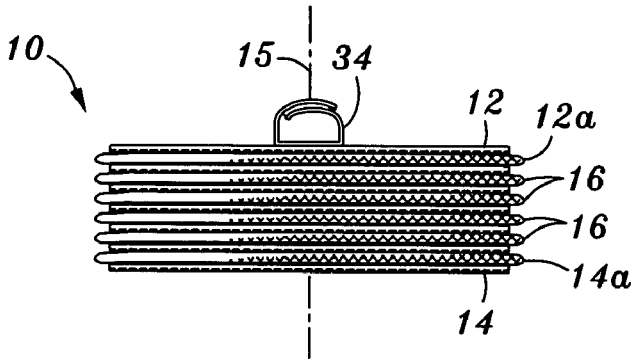
FIG. 6 is a side view of the collapsible bag of FIG. 3 in a collapsed position.

Referring now to the drawings wherein the showings are for purposes of illustrating preferred embodiments of the collapsible bag only, and not for purposes of limiting the same, FIGS. 1, 2 and 3 illustrate a collapsible bag 10 in an expanded position. FIG. 6 illustrates the collapsible bag 10 in a collapsed position. The collapsible bag 10 shown in FIGS. 1, 2 and 3 has an upper end, a lower end and four vertical sides. References to up, upper, upper end, top, down, downward, lower end and bottom are relative to the orientation shown in FIG. 1 in which the lower end of the collapsible bag 10 is disposed toward the earth.

The collapsible bag 10 is advantageously comprised of a top panel 12, a bottom panel 14, at least one intermediate panel 16, at least one side wall 18, and at least one divider panel 26. At the lower end is the bottom panel 14 which defines a bottom panel perimeter 14*a* extending around an outer periphery of the bottom panel 14. A tension loop 20 extends around the bottom panel perimeter 14*a*, as can be seen in FIG. 1B.

At the upper end is the top panel 12 which is spaced apart from and axially aligned with the bottom panel 14 along longitudinal axis 15. The top panel 12 is preferably, but optionally, oriented generally parallel to the bottom panel 14. The top panel 12 defines a top panel perimeter 12*a*. Preferably, but optionally, the tension loop 20 extends around the top panel perimeter 12*a*. The intermediate panel 16 is also axially aligned with the top and bottom panels 12, 14 and is interposed between the top and bottom panels 12, 14. The intermediate panel 16 is preferably disposed in generally parallel arrangement relative to the top and bottom panel 12, 14.

As shown in FIGS. 1–3 and 7–8, the side wall 18 forms vertical sides when the collapsible bag 10 is in the expanded position. The top and bottom panels 12, 14 may be generally horizontally-disposed as are the intermediate panels 16 while the side wall 18 and divider panels 26 may be generally vertically-disposed. The intermediate, bottom and divider panels 16, 14, 26 and side wall 18 respectively, each have flexible material extending contiguously and uninterrupted over a substantial portion, and preferably all, of each one of the panels 16, 14, 26 and side wall 18. The material is preferably substantially uninterrupted in that one or more small openings can be used, such as for ventilation or for viewing. Any such openings are preferably small relative to the size of the panel in which the openings are formed, with no single opening preferably more than 20% of the area of the panel. Moreover, the openings are such that they do not degrade to any appreciable extent the ability of the spring-loop frame or tension-loop frame 20 hold the material taut for its intended use.

As can be seen in FIGS. 1, 2 and 3, the intermediate panel 16 defines an intermediate panel perimeter 16*a* and has a tension loop 20 extending therearound. The panels 12, 14 and 16 have a similar construction. The side wall 18 is partially joined to the top, intermediate and bottom panel perimeters 12*a*, 14*a*, 16*a* between the top and bottom panels 12, 14. In this manner, the side wall 18 is configured to partially enclose the collapsible bag 10 such that the top, bottom and intermediate panels 12, 14, 16 and side wall 18 collectively define a plurality of bays 22. Each bay 22 has an intermediate panel 16 forming a top and bottom of the bay 22 with the side wall 18 enclosing at least a portion of the bay 22. The side wall 18 also joins the top and bottom panels 12, 14 forming that particular bay 22. The top-most bay 22 has top panel 12 forming the top of the bay 22. The bottom-most bay 22 has the bottom panel 14 forming the bottom of the bay 22. The side wall 18 may be comprised of a single contiguous piece of fabric material or it may be comprised of a plurality of sections of fabric material.

In the configuration shown in FIGS. 1–3 and 7–8, the collapsible bag 10 is comprised of a plurality of side walls 18 formed of fabric mesh material. Each one of the side walls 18 extends between adjacent ones of the top, intermediate and bottom panels 12, 14, 16. Upper and lower edges of the side walls 18 are joined to the top, intermediate and bottom panels 12, 14, 16 at the respective ones of the top, intermediate and bottom panel perimeters 12*a*, 14*a*, 16*a*, such as by sewing. Alternate means of joining the top, intermediate and bottom panels 12, 14, 16 to the side walls 18 may be used. For example, the top, intermediate and bottom panels 12, 14, 16 may be joined to the side walls 18 by gluing or with mechanical fasteners.

The side wall 18 may also define at least one opening 24 on one or more of the vertical sides. The opening 24 of the side wall 18 may include hemming extending along at least a part of a length of the opening 24. The hemming may be formed of a piece of nylon fabric material that may be sewn or otherwise secured to the fabric mesh material of each one of the side walls 18. Such nylon hemming of the opening 24 may provide greater durability and resistance against stretching and tearing that that which may be provided by the fabric mesh material acting alone. Stretching of the side wall 18 may occur during insertion and removal of objects into the bays 22. The opening 24 may preferably, but optionally, be disposed on a lateral side of the collapsible bag 10, as can be seen in FIGS. 1 and 2. The opening 24 allows access into an interior of the collapsible bag 10. The opening 24 may be shaped in any number of configurations.

In this regard, the opening 24 may have an oval or circular shape or it could have a rectangular shape of any size. The opening 24 may be positioned along each one of the bays 22 adjacent the side wall 18. The opening 24 may also be configured as a slit in the side walls 18 adjacent each one of the bays 22. However, the size and shape of the opening 24 shown in FIGS. 1 and 2 (wherein the side wall 18 partially extends around three of four of the vertical sides of the collapsible bag 10) is believed to be advantageous. In FIGS. 1 and 2, the opening 24 extends from the top panel 12 to the bottom panel 14 to provide access to each bay 22. An entire side of the collapsible bag 10 thus forms the opening 24.

Each one of the top, intermediate, bottom and divider panels 12, 14, 16, 26 and the side wall 18 may be fabricated from flexible material such as fabric material. The collapsible bag 10 of FIGS. 1–8 is shown with a fabric mesh material covering a substantial portion, and preferably all, of each one of the panels 12, 14, 16, 26 and the side wall 18. The flexible material may be either perforated or non-perforated. In addition, the flexible material may be a transparent material such as clear plastic. The flexible material may also be translucent so as to distort light passing therethrough. The flexible material may also be an opaque material. Furthermore, the panels 12, 14, 16, 26 and the side wall 18 of the collapsible bag 10 may be fabricated from a combination of perforated and non-perforated material.

Preferably, but optionally, the intermediate and bottom panels 14, 16 may each be fabricated from fabric mesh material, as is shown in FIGS. 1–8, with strips of nylon fabric being used as hemming around the intermediate and bottom panel perimeters 14*a*, 16*a*. Alternatively, the intermediate and bottom panels 14, 16 may be fabricated entirely from nylon fabric for improved wear resistance against the soles of shoes that may be inserted into the bays 22. The use of nylon fabric instead of fabric mesh material in the top, intermediate and bottom panels 14 may also retain dirt particles and/or debris carried on objects such as shoes that may be placed into the bays 22. The use of nylon fabric may prevent such debris from falling into shoes resting in bays 22 immediately below. Finally, the use of nylon fabric for the fabrication of the top, intermediate and bottom panels 12, 14, 16 may conceal the tension loops 20 such that the aesthetics of the collapsible bag 10 may be enhanced.

As is depicted in FIGS. 1–8, the side walls 18 may preferably, but optionally, be fabricated from fabric mesh material such that the collapsible bag 10 has improved breathability in order to allow for the evaporation of moisture that may contained in objects that are stored in the bays 22. However, the panels 12, 14, 16, 26 and the side wall 18 may be fabricated from any combination of flexible material such that the collapsible bag 10 may be readily and repeatedly moved from the collapsible position to the expanded position, and vice versa.

Importantly, the tension loops 20 of the collapsible bag 10 are configured to outwardly urge the flexible material extending over each one of the top, intermediate and bottom panels 12, 14, 16 such that the flexible material is generally held taut. Due to the tautness of the flexible material, the load-carrying capability of each one of the intermediate panels 16 and the bottom panel 14 is enhanced such that the panels 14, 16 sag less. In this manner, items placed in the bays 22 are better supported.

In addition, the tautness of the flexible material may prevent contact between objects in adjacent upper and lower ones of the bays 22. More specifically, the tautness of the bottom and intermediate panels 14, 16 may prevent sagging under the weight of objects in the bays 22. Furthermore, the tautness of the bottom and intermediate panels 14, 16 may also prevent interference with objects already resting in the bottom and intermediate panels 14, 16 as additional objects are inserted and removed from the bays 22.

Figure 7:
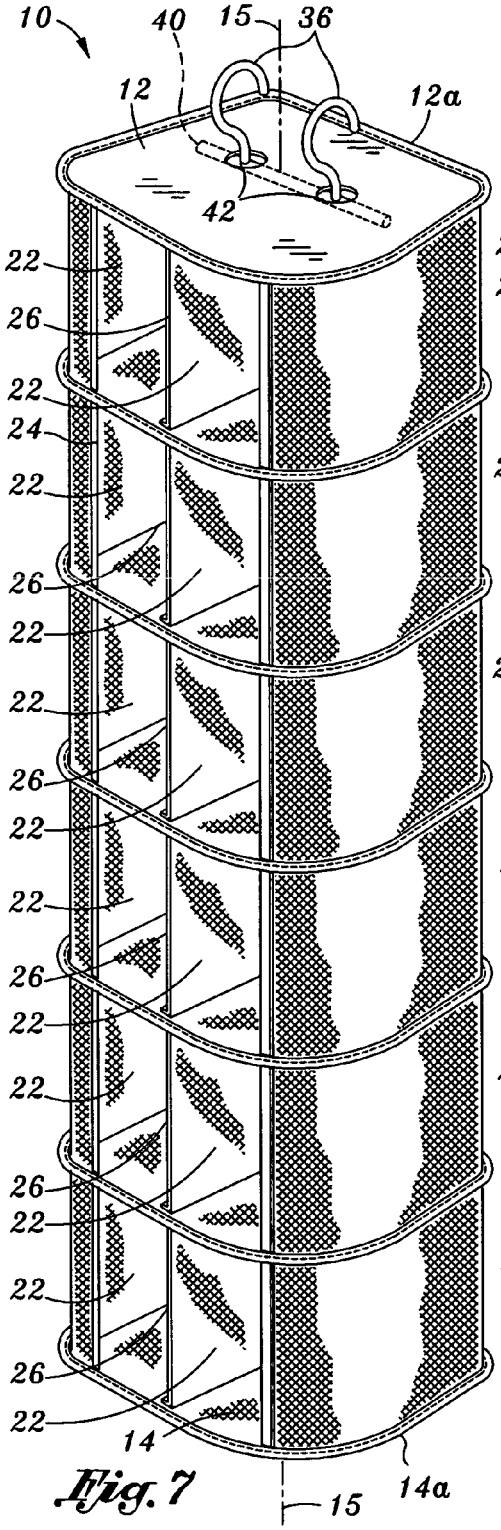
FIG. 7 is a perspective view of the collapsible bag including divider panels and illustrating a pair of hook elements extending upwardly from the top panel.
Figure 8:
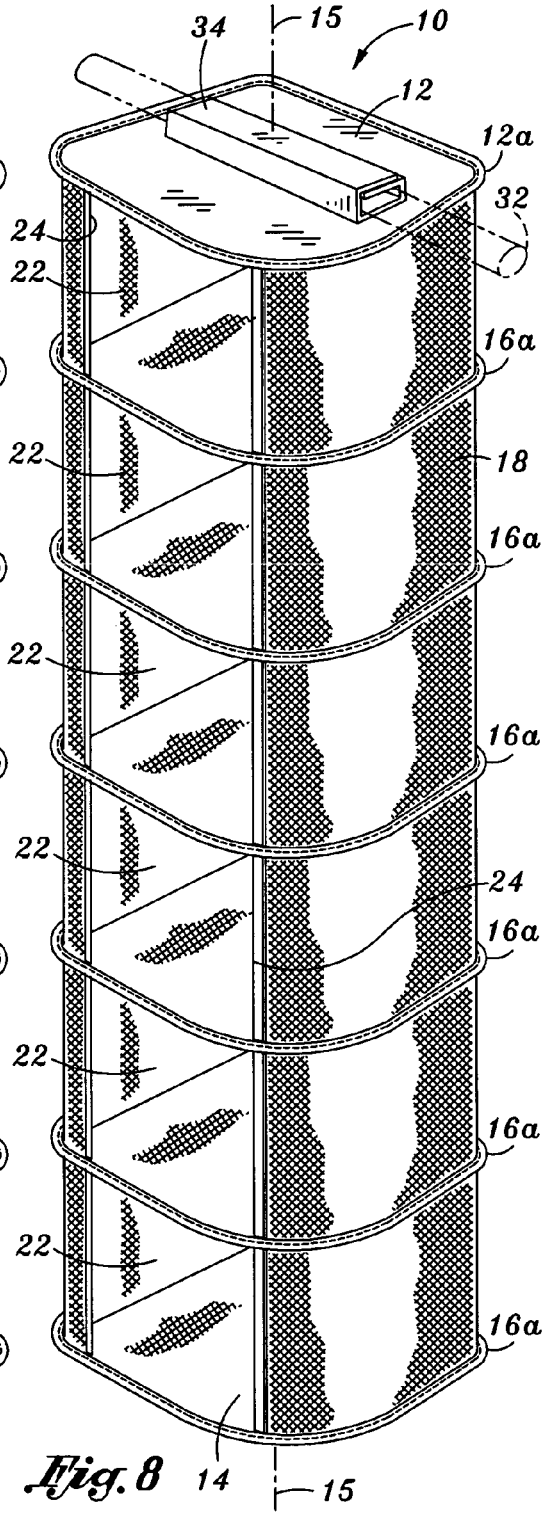
FIG. 8 is a perspective view of the collapsible bag being devoid of divider panels.

Referring to FIG. 7, the collapsible bag 10 shown includes twelve separate ones of the bays 22. However, the collapsible bag 10 may be configured to have any number of bays 22. For example, as is illustrated in FIG. 8, the collapsible bag 10 is shown wherein the divider panels 26 have been omitted such that only six of the bays 22 are defined. However, the collapsible bag 10 may be configured such that more than one divider panel 26 may be installed between adjacent ones of the top, intermediate and bottom panels 12, 14, 16. For example, two of the divider panels 26 may be installed between the top panel 12 and the immediately adjacent one of the intermediate panels 16 such that three of the bays 22 are defined. In this regard, the divider panels 26 advantageously provide an organizational feature to the collapsible bag 10.

Additionally, it is contemplated that the intermediate panels 16 may also be omitted leaving only the top, bottom and divider panels 12, 14, 26 and side wall 18 to collectively define only two of the bays 22 of the collapsible bag 10. However, the collapsible bag 10 may be configured such that the divider panels 26 and the intermediate panels 16 may be altogether omitted wherein only a single bay 22 may be collectively defined by the top and bottom panels 12, 14 and the side wall 18. As can be seen, the collapsible bag 10 may be configured such that any number of bays 22 may be defined by altering the quantity of divider panels 26 and intermediate panels 16.

Referring still to FIG. 1, the divider panels 26 may be interposed between adjacent ones of the top, intermediate and bottom panels 12, 14, 16. Each one of the divider panels 26 includes a top edge, a bottom edge opposing the top edge, and a pair of opposing lateral edges. In the configuration of the collapsible bag 10 shown in FIG. 1, the top edge and the bottom edge of one of the divider panels 26 may be secured to respective ones of the top panel 12 and the immediately adjacent one of the intermediate panels 16. Such securement of the divider panels 26 may be by sewing, gluing, rivets and other means of fastening such parts. The divider panel 26 may preferably, but optionally, be oriented such that one of the lateral edges is exposed to the opening 24, as is shown in FIGS. 1, 2, 7 and 8.

The lateral edge opposite that which is exposed to the opening 24 may be disposed adjacent to the side wall 18. Preferably, but optionally, the lateral edge adjacent the side wall 18 may be freely disposed adjacent the side wall 18. However, it is contemplated that the lateral edge that is disposed adjacent to the side wall 18 may be secured to the side wall 18 by sewing, gluing, with mechanical fasteners or by other suitable means. Alternatively, the top and bottom edges of the divider panels 26 may be secured to adjacent ones of the top, intermediate and bottom panels 12, 14, 16 with hook and loop fasteners such that the divider panels 26 may be readily installed and removed from the collapsible bag 10. By configuring the divider panels 26 to be removable, the quantity of the bays 22 may be readily altered.

As can be seen in FIGS. 1–8, the top, intermediate and bottom panels 12, 14, 16 are generally rectangularly-shaped or square-shaped with each one of the panels having generally straight sides and rounded corners. Each of the top, intermediate and bottom panels 12, 14, 16 may preferably, but optionally, be substantially identically shaped and sized. Alternatively, it is contemplated that the panels 12, 14, 16 may be shaped and sized in varying configurations along a length of the collapsible bag 10. The particular shape of the panels 12, 14, 16 may vary from circular to oval to various forms of rectangles or triangles. However, the generally rectangular shape similar to that shown in FIGS. 1–8 is believed to be advantageous. The corners are rounded in order to accommodate the use of the tension loops 20 that hold the panels 12, 14, 16, taut.

Referring briefly to FIG. 1*a*, a stiffener panel 28 may be included with the top panel 12. The stiffener panel 28 may be sized to be complimentary to the top panel 12 and may be abuttingly disposed against the top panel 12 or to comprise the top panel 12. The stiffener panel 28 may be configured to provide a greater degree of rigidity or stiffness than that which may be provided by the combination of the flexible material of the top panel 12 with the tension loop 20. The stiffener panel 28 may be fabricated from a sheet of cardboard, fiberboard, plastic or other suitable material.

The increased rigidity or stiffness that may be imparted by the stiffener panel 28 may enhance the weight-supporting capability of the collapsible bag 10 when the collapsible bag 10 is suspended from a hanger member 30 similar to that shown in FIG. 1 and as will be described in greater detail below. However, it is contemplated that the top panel 12 itself may be configured to be substantially stiff such that the top panel 12 may be maintained in a substantially planar orientation when the collapsible bag 10 is suspended by the hanger member 30. If a stiffener panel 28 is included with the top panel 12, the stiffener panel 28 may be sandwiched between fabric layers of the top panel 12 and may be sized to be slightly smaller that the top panel perimeter 12*a*, as can be seen in FIG. 1*a*. A seam extending around the top panel perimeter 12*a* prevents lateral movement of the stiffener panel 28 within the confines of the fabric layers of the top panel 12. However, the stiffener panel 28 may also be secured to an upper or lower exterior side of the top panel 12. Furthermore, the stiffener panel 28 may comprise a plate that is inserted inside the collapsible bag 10 with the fabric of top panel 12 disposed on top of the stiffener panel 28, or fastened to a periphery of the stiffener panel 28.

Referring now to FIG. 1*b*, shown is an arrangement for securing the tension loops 20 to respective ones of the top, intermediate and bottom panel perimeters 12*a*, 4*a*, 16*a*. A continuous perimeter tunnel or pocket 38 is shown as being formed at the top, intermediate and bottom panels 12, 14, 16. The perimeter pocket 38 may be fabricated from a separate strip of fabric, such as nylon fabric, which may be sewn into the shape of the perimeter pocket 38 and may be separately secured to the panels 12, 14, 16 by sewing or by other suitable means. However, it is contemplated that the perimeter pocket 38 may be secured to the respective ones of the panels 12, 14, 16 by any number of alternative means. One such means includes a perimeter edging 39 that may be sewn to the panels 12, 14, 16 in a manner illustrated in FIG. 1*c*. Alternatively, the perimeter edging 39 may be glued, riveted or otherwise fastened to the periphery.

As is shown in FIG. 1*b*, the tension loop 20 may be enclosed within the perimeter pocket 38 in each one of the panels 12, 14, 16. Each of the perimeter pockets 38 may be formed as a continuous loop extending around the respective ones of the top, intermediate and bottom panels 12, 14, 16. The perimeter pocket 38 may be formed as a part of the top, intermediate and bottom panels 12, 14, 16 wherein the fabric covering the top, intermediate and bottom panels 12, 14, 16 is folded back onto itself and sewn to a major portion of the fabric with the tension loop 20 being enclosed therewithin.

Alternatively, the nylon fabric of the perimeter pocket 38 may be sewn to the fabric mesh material which may cover a majority of the intermediate and bottom panels 14, 16. Likewise, the nylon fabric of the perimeter pocket 38 may be sewn to nylon fabric material which may cover the top panel 12. Additionally, spaced-apart segments (not shown) of perimeter pockets 38 may be disposed about each one of the top, intermediate and bottom panel perimeters 12*a*, 14*a*, 16*a*. The spaced-apart segments may be configured to confine the tension loops 20 at spaced intervals as opposed to the continuous confinement of the tension loops 20 within the perimeter pocket as shown in FIGS. 1–8. In yet another alternative, the tension loops 20 may be secured to respective 14*a*, 16*a* by the use of mechanical fasteners such as with straps, rivets or other suitable means.

However, it is believed that enclosing the tension loops 20 in the continuous perimeter pocket 38 is advantageous because the perimeter pocket 38 may protect against personal or property damage that may be otherwise caused by contact with edges of the tension loops 20. Furthermore, it is believed that nylon fabric may advantageously provide a relatively high degree of durability that may prevent edges of the tension loops 20 from tearing the perimeter pocket 38 during the outwardly urging force that is applied by each of the tension loops 20.

Referring briefly to FIG. 1*b*, the tension loop 20 is shown with a rectangular cross-section. The tension loop 20 may preferably, but optionally, be fabricated from flexible strap material such as fiberglass, plastic or a steel alloy such as spring steel wherein the tension loop 20 may outwardly urge the respective ones of the top, intermediate and bottom panels 12*a*, 14*a*, 16*a*. The tension loop 20 may have a generally rectangular cross sectional shape and may be oriented within the perimeter pocket 38 such that the longitudinal axis of the tension loop 20 is generally aligned with the longitudinal axis 15, as can be seen in FIGS. 1B and 1C. Other cross-sectional shapes may be used for the tension loops 20.

For example, the tension loops 20 may have a circular cross-sectional shape. In addition, each one of the tension loops 20 may be formed as an endless or continuous loop although each of the tension loops 20 may be configured as a discontinuous section having opposing ends that may be adjustably coupled together to form a loop. By providing the feature of adjustably coupling the ends of the tension loops 20, the degree of tautness in the flexible material covering each one of the top, intermediate and bottom panels 12, 14, 16 may be controlled.

Advantageously, a hanger member 30 may be included in the collapsible bag 10. As is shown in FIGS. 1, 4, 7 and 8, the hanger member 30 may be attached to the collapsible bag 10 and may be secured to an exterior surface of the top panel 12. The hanger member 30 may be oriented parallel to the opening 24. The hanger member 30 may be configured to engage a horizontally-disposed pole 32 such as a clothes hanger pole of the type typically used in a clothing closet. The hanger member 30 may be configured to engage the horizontally-disposed pole 32 having a generally circular cross section. However, the hanger member 30 may be configured to engage any number of devices from which the collapsible bag 10 may be suspended. The hanger member 30 may be oriented such that the opening 24 of the collapsible bag 10 is oriented parallel to the orientation of the pole 32. In this manner, objects such as shoes may be easily inserted into and removed from the bays 22 through the opening 24 when the collapsible bag 10 is suspended in a closet with the opening 24 facing a door of the closet.

The hanger member 30 may comprise a sleeve member 34 similar to that shown in FIGS. 1–4 and 6–7. Such a sleeve member 34 may preferably, but optionally, be fabricated from nylon fabric material and may be configured to be releasably mounted on the horizontally disposed pole 32 such as the clothes hanger pole described above. In this regard, the dimensions of the sleeve member 34 may preferably, but optionally, be sized such that the sleeve member 34 is large enough to wrap around the pole 32 yet small enough to provide a sufficient amount of clearance wherein the sleeve member 34 may be slid over the pole 32.

Figure 4:
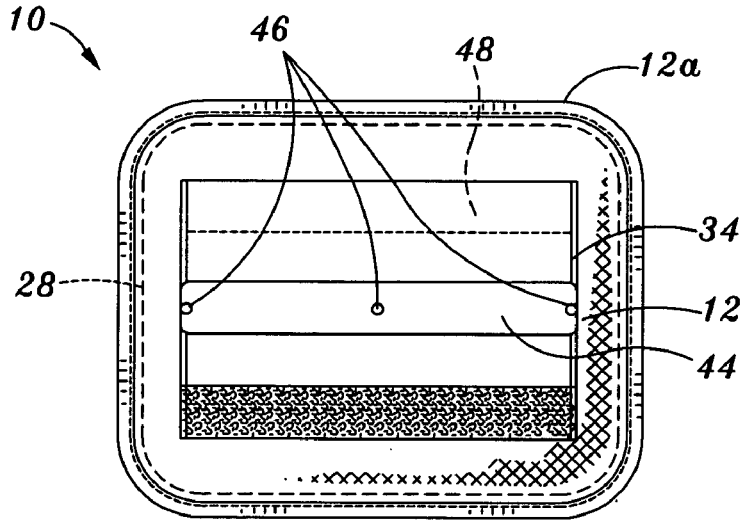
FIG. 4 is a top view of the collapsible bag taken along line 4—4 of FIG. 2 illustrating a hanger member disposed upon the top panel.
Figure 5:
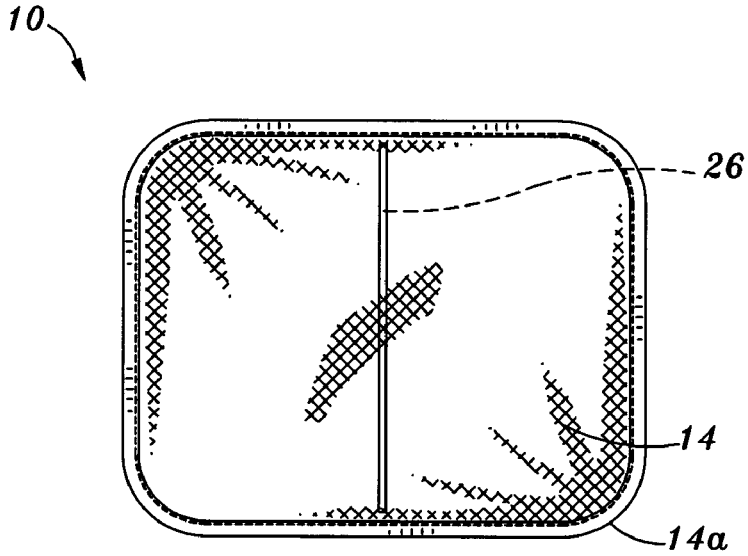
FIG. 5 is a bottom view of the collapsible bag taken along line 5—5 of FIG. 3 illustrating the bottom panel perimeter 16*a* of the bottom panel.

Turning briefly to FIG. 4, the sleeve member 34 may have a generally orthogonal shape extending substantially across a width of the top panel 12. In this regard, the sleeve member 34 may be rectangularly-shaped although any number of alternate shapes for the sleeve member 34 may be workable. The sleeve member 34 may include opposing ends that are freely disposed. A middle portion of the sleeve member 34 may be secured to the top panel 12 as by way of mechanical fasteners such as rivets 46, as can be seen in FIG. 4. Alternatively, the sleeve member 34 may be secured to the top panel 12 and stiffener panel 28 by other means such as by sewing.

Advantageously, the stiffener panel 28 may be abuttingly disposed against the top panel 12, as was earlier described. In such configurations, the sleeve member 34 may be secured to both the top panel 12 and the stiffener panel 28 such that suspension loads may be better distributed. Additionally, a stiffener strap 44 may preferably, but optionally, be secured to an outer portion of the sleeve member 34 such that the sleeve member 34 may be captured between the stiffener strap 44 and the top panel 12. In this manner, rivets 46 securing the sleeve member 34 to the top panel 12 may not pull through the sleeve member 34 when the collapsible bag 10 is heavily laden. The stiffener strap 44 may preferably be fabricated from plastic sheet although various other materials may be used.

The stiffener panel 28 may be configured to prevent undue sagging of the top panel 12 when the collapsible bag 10 is suspended such that the overall shape of the collapsible bag 10 is maintained when objects are resting in the bays 22. In this regard, the divider panels 26 may also provide load-carrying capability such that center portions of the intermediate and bottom panels 16, 18 are supported in addition to the load-carrying capability provided by the side wall 18. Thus, in addition to providing the above-described organizational feature to the collapsible bag 10, the divider panels 26 may also assist in maintaining the shape of the collapsible bag 10.

Referring still to FIG. 4, the opposing ends of the sleeve member 34 may be hemmed to prevent fraying of the fabric material. As is shown in FIG. 4, the hook and loop fasteners 48 may be secured to respective ones of the ends of the sleeve member 34 such that the sleeve member 34 may be releasably secured to the pole 32 by overlapping the opposing ends. However, it is contemplated that mechanical fasteners such as snaps or other suitable means may be used to secure the opposing ends together. Alternatively, the sleeve member 34 may be formed as a tubular sleeve sized and configured to be complementary to the pole 32 from which the collapsible bag 10 may be hung.

Optionally, the hanger member 30 may be comprised of a pair of spaced hook elements 36 affixed to and extending upwardly from the top panel 12 as is shown in FIG. 7. As can be seen in FIG. 7, the hook elements 36 extend through a pair of complementary spaced hook holes 42 formed in the top panel 12 and in the stiffener panel 28, if included. The hook elements 36 may be configured to be removably engaged to the horizontally-disposed pole 32 such as the clothes pole described above. In this regard, the hook elements 36 may be configured in a shape similar to the shape of a standard clothes hanger. Preferably, but optionally, the spacing of the hook elements 36 may be such that the vertical loads may be substantially evenly distributed to the side wall 18 and to the divider panel 26 of the collapsible bag 10.

As shown in FIG. 7, the hook elements 36 may be secured to an elongate hook beam 40 that is disposed on a lower side of the top panel 12 and extends substantially across the width of the top panel 12. The hook beam 40 may have a tubular or circular cross-sectional shape and may be fabricated from wooden dowel rod or metallic tubing although it is recognized herein that there are an infinite number of configurations in which that hook beam 40 may be fabricated.

Similarly, there are an infinite number of materials from which the hook beam 40 may be fabricated. Regardless of its configuration or the material from which it may be fabricated, it is preferable that the hook beam 40 be configured with sufficient strength and stiffness characteristics such that the collapsible bag 10 may be suspended therefrom while substantially spreading the suspension loads across the top panel 12.

The above description is given by way of example and not limitation. Given the above disclosure, one skilled in the art could devise variations that are within the scope and spirit of the invention, including various ways of configuring the shape of the top, intermediate, bottom and divider panels 12, 14, 16, 26 and side wall 18. Furthermore, the various features of this invention can be used alone, or in varying combinations with each other and are not intended to be limited to the specific combination described herein. Thus, the invention is not to be limited by the illustrated embodiments but is to be defined by the following claims when read in the broadest reasonable manner to preserve the validity of the claims.

What is claimed is:

1. A collapsible bag, comprising:

a bottom panel defining a bottom panel perimeter;

a top panel axially aligned with and disposed in spaced relation to the bottom panel, the top panel defining a top panel perimeter;

at least one intermediate panel axially aligned with and interposed between the top and bottom panel, the intermediate panel defining an intermediate panel perimeter and having a flexible tension loop extending therearound;

a side wall partially extending around and joined to the top, bottom and intermediate panel perimeters to partially enclose the collapsible bag such that the top, bottom, and intermediate panels cooperate with the side wall to define a plurality of bays, the side wall defining an opening of the collapsible bag;

at least one divider panel extending between and joined to adjacent ones of the top, intermediate and bottom panels, the divider panel being configured to divide each one of the bays and being oriented such that objects may be inserted into and removed from the bays through the opening; and wherein the intermediate and divider panels and side wall have flexible material extending over a substantial portion of each one of the panels and side wall, the perimeters of each intermediate and divider panel having a tension loop such that the flexible material on such panel with the tension loop is held taut by the loop.

2. The collapsible bag of claim 1 wherein each one of the divider panels is sewn to adjacent ones of the top, intermediate and bottom panels.

3. The collapsible bag of claim 1 wherein the top, intermediate and bottom panels are rectangularly shaped and at least one of the top and bottom panels has a tension loop and flexible material there over.

4. The collapsible bag of claim 3 wherein the top, intermediate and bottom panels are substantially identically shaped and sized.

5. The collapsible bag of claim 3 wherein a plurality of the top, bottom and intermediate panels includes a perimeter pocket extending around each one of the top, intermediate and bottom panel perimeters having the pocket and the pocket is configured to enclose the tension loop therewithin such that the tension loop may outwardly urge the panels having the pockets.

6. The collapsible bag of claim 5 wherein the perimeter pocket is formed from at least a portion of the material covering the top, intermediate and bottom panels.

7. The collapsible bag of claim 5 wherein the perimeter pocket is sewn to the intermediate and bottom panels.

8. The collapsible bag of claim 1 wherein the top panel includes a stiffener panel formed of stiff material to support a periphery to which the side wall attaches.

9. The collapsible bag of claim 8 further comprising:

a hanger member secured to an exterior surface of the top panel and oriented generally parallel to the opening, the hanger member being configured to engage a horizontally-disposed pole such that the collapsible bag may be suspended therefrom during use of the collapsible bag.

10. The collapsible bag of claim 9 wherein the hanger member is a sleeve member configured to be releaseably mounted on the pole.

11. The collapsible bag of claim 9 wherein the hanger member is a pair of spaced hook elements affixed to and extending upwardly from the top panel.

12. The collapsible bag of claim 1 wherein the bottom, intermediate and divider panels and side wall are fabricated from fabric mesh material.

13. The collapsible bag of claim 1 wherein the top panel is fabricated from nylon fabric.

14. The collapsible bag of claim 1 wherein the tension loop is fabricated from fiberglass material.

15. The collapsible bag of claim 1 wherein the tension loop is fabricated from plastic material.

16. The collapsible bag of claim 1 wherein the tension loop is fabricated from spring steel material.

17. A collapsible bag, comprising:

a generally horizontally-disposed bottom panel defining a bottom panel perimeter;

a generally horizontally-disposed top panel axially aligned with and disposed in spaced relation to the bottom panel, the top panel defining a top panel perimeter;

at least one generally horizontally-disposed intermediate panel axially aligned with and interposed between the top and bottom panel, the intermediate panel defining an intermediate panel perimeter;

a generally vertically-disposed side wall partially extending around the top, bottom and intermediate panel perimeters to partially enclose the collapsible bag such that the top, bottom, and intermediate panels cooperate with the side wall to define a plurality of bays, the side wall defining an opening;

at least one generally vertically-disposed divider panel extending between adjacent ones of the top, intermediate and bottom panels, the divider panel being configured to divide each one of the bays and being oriented such that objects may be inserted into and removed from the bays through the opening; and wherein the top, intermediate, bottom and divider panels and side wall have flexible material extending over a substantial portion of each one of the panels with tension loops in a plurality of the top, intermediate and bottom panels, the tension loops being configured to outwardly urge said plurality of top, bottom and intermediate panel perimeters such that the flexible material extends substantially uninterrupted over said plurality of the top, intermediate and bottom panels and is generally held taut.

18. The collapsible bag of claim 17 wherein each one of the divider panels is sewn to adjacent ones of the top, intermediate and bottom panels.

19. The collapsible bag of claim 17 further including:

a hanger member secured to an exterior surface of the top panel;

wherein the top panel is configured to be substantially stiff such that the top panel may be maintained in a planar orientation when the collapsible bag is suspended by the hanger member.

20. A collapsible bag, comprising:

a generally horizontally-disposed bottom panel defining a bottom panel perimeter with a continuous perimeter pocket secured to the bottom panel at the bottom panel perimeter, the bottom panel having a flexible tension loop extending around the bottom panel perimeter to confine the tension loop;

a generally horizontally-disposed top panel axially aligned with and disposed in spaced relation to the bottom panel, the top panel defining a top panel perimeter;

at least two generally horizontally-disposed intermediate panels axially aligned with and interposed between the top and bottom panel, the at least two intermediate panels defining an intermediate panel perimeter with a continuous perimeter pocket secured to each of the at least two intermediate panels at the intermediate panel perimeter, the at least two intermediate panels each having a flexible tension loop extending around the intermediate panel perimeter inside the pocket;

a generally vertically-disposed side wall partially extending around the top, bottom and intermediate panel perimeters to partially enclose the collapsible bag such that the top, bottom, and intermediate panels cooperate with the side wall to define a plurality of bays, the side wall defining an opening;

at least one generally vertically-disposed divider panel extending between adjacent ones of the top, intermediate and bottom panels, the divider panel being configured to divide each one of the bays and being oriented such that objects may be inserted into and removed from the bays through the opening; and wherein the intermediate and divider panels and side wall have flexible material extending over a substantial portion of each one of the panels with the tension loops being configured to outwardly urge the at least two intermediate panel perimeters such that the flexible material on each of the at least two intermediate panels is generally held taut.

* * * * *